United States Patent [19]

Raspanti

[11] 4,210,763

[45] Jul. 1, 1980

[54] WATER-SOLUBLE ACID ADDITION OR QUATERNARY AMMONIUM SALTS USEFUL IN ELIMINATING OR PREVENTING THE BRIGHTENING EFFECTS OF ANIONIC OPTICAL BRIGHTENERS

[75] Inventor: Giuseppe Raspanti, Fiorano al Serio, Italy

[73] Assignee: Sandoz Ltd., Basel, Switzerland

[21] Appl. No.: 900,175

[22] Filed: Apr. 26, 1978

Related U.S. Application Data

[60] Division of Ser. No. 758,134, Jan. 10, 1977, Pat. No. 4,098,954, which is a continuation of Ser. No. 516,579, Oct. 21, 1974, abandoned.

[51] Int. Cl.[2] ..... C07D 403/14

[52] U.S. Cl. ..... 548/350

[58] Field of Search ..... 548/350, 352, 354

[56] References Cited

U.S. PATENT DOCUMENTS

| | | | |
|---|---|---|---|
| 2,374,354 | 4/1945 | Kaplan | 548/350 |
| 2,874,074 | 2/1959 | Johnson | 548/354 |
| 3,639,642 | 3/1969 | Matter et al. | 548/350 |
| 3,855,235 | 12/1974 | McConnell | 548/349 |

*Primary Examiner*—Henry R. Jiles
*Assistant Examiner*—Jane T. Fan
*Attorney, Agent, or Firm*—Gerald D. Sharkin; Richard E. Vila; Joseph J. Borovian

[57] ABSTRACT

Water-soluble acid addition or quaternary ammonium salts of compounds produced by acylation of an excess of diethylene triamine by isophthalic or terephthalic acid or a functional derivative thereof, subsequently cyclizing the product to afford imidazoline groups, and reacting the product further by way of acylation with a bifunctional acylating agent which is a saturated aliphatic dicarboxylic acid or a functional derivative thereof, or a functional derivative of carbonic acid. Such salts are useful for eliminating or preventing the brightening effect on materials, e.g. such fibrous material as textiles and paper, of anionic optical brightening agents.

13 Claims, No Drawings

WATER-SOLUBLE ACID ADDITION OR QUATERNARY AMMONIUM SALTS USEFUL IN ELIMINATING OR PREVENTING THE BRIGHTENING EFFECTS OF ANIONIC OPTICAL BRIGHTENERS

This is a division of application Ser. No. 758,134, filed January 10, 1977, now issued as U.S. Pat. No. 4,098,954, which in turn is a continuation, of application Ser. No. 516,579, filed Oct. 21, 1974, now abandoned.

The present invention relates to a method for eliminating or preventing the brightening effect on materials of anionic optical brightening agents involving the use of hydrosoluble acid addition salts or quaternary ammonium salts of compounds containing the group of formula,

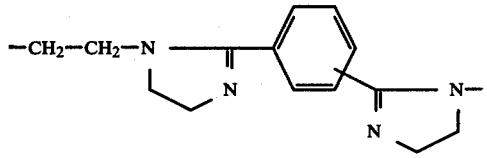

wherein the benzene radical is attached to the other two parts of the group at its m- or p-positions.

The brightening effects on materials, particularly fibrous materials, obtained by treatment of the materials with optical brightening agents are not always required, and accordingly, there exists a need for substances possessing the property of eliminating the brightening effects on such materials previously undesirably brightened, or preventing such effects from occurring. This situation arises particularly in the paper industry, wherein it is often desired to produce a batch of non-brightened paper in a machine previously used to produce brightened paper. Between the production of the two sorts of paper, the machine and its whole reverse-run system must normally be thoroughly cleaned in order that the residues of optical brighteners be removed, and thus preventing the subsequent batch of paper from being undesirably brightened. Such a cleaning operation is costly, time-consuming and so reduces the paper production capacity. It is more economical to avoid the need for such a cleaning operation by using some form of brightening eliminator during or after the paper formation, such that any brightener undesirably incorporated in the paper during production is "neutralized". Amongst other applications, the present invention is directed at a method of eliminating or preventing the unwanted brightening effects involving the addition of the previously mentioned salts to the paper at an appropriate stage in its production. Included amongst the situations wherein the present invention is of benefit is that where it is desired to produce non-brightened paper from waste paper containing an optical brightener.

More particularly, the present invention has for its purpose the elimination from a material of brightening effects produced by optical brighteners containing anionic groups, e.g. those derived from sulphonic acid groups, or the prevention in a material of brightening effects from being produced by such optical brighteners. Accordingly, it provides a method of eliminating the brightening effect produced by or preventing the brightening effect from being produced by an anionic optical brightener on material by the application to the material substrate of a water-soluble acid addition salt or quaternary ammonium salt of a compound containing the group of formula,

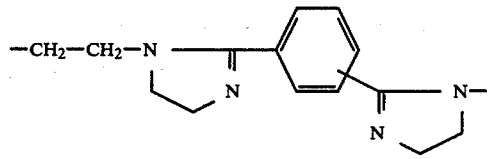

wherein

The benzene radical is attached to the other two parts of the group at its m- or p-positions, which compound is produced by the acylation of an excess of a polyethylenepolyamine of formula II, $$H(HN—CH_2—CH_2)_p—NH_2 \qquad II$$

in which p is an integer 2 to 5, by isophthalic or terephthalic acid or a functional derivative thereof in a molar ratio exceeding 1.5:1, subsequently cyclizing the product to afford imidazoline groups, and optionally reacting the product further by way of partial or full alkylation and/or by way of acylation in a molar ratio of initial to present acylating agent of 1:0.3 to 1:1.0, with a bifunctional acylating agent which is a saturated aliphatic dicarboxylic acid of formula III, $$HOOC—(CH_2)_q-COOH \qquad III$$

in which q is an integer 1 to 6, or a functional derivative thereof, or a functional derivative of carbonic acid.

The compounds produced in the above described process, have the effect, in salt form, of eliminating or preventing the brightening effects of anionic optical brighteners on material substrates, and are hereinafter referred to as the "brightening-eliminating" compounds.

In the above method, the functional derivatives of isophthalic or terephthalic acid contemplated include the anhydride, acid halides and esters thereof. The alkyl groups incorporated in the brightening-eliminating compound through alkylation or quaternary ammonium salt formation are selected from methyl and ethyl, either of which may be substituted by a phenyl or naphthyl group. Suitable functional derivatives of the saturated aliphatic dicarboxylic acids of formula III include their diesters, particularly dimethyl esters, and of carbonic acid include a halide or ester thereof, a mixed halide-ester, and urea. Examples of such carbonic acid derivatives besides urea, are phosgene, diethyl carbonate and ethyl chlorocarbonate. Acids from which the acid addition salts of the brightening-eliminating compounds can be produced include inorganic acids, e.g. hydrochloric, hydrobromic and sulphuric acids, aromatic sulphonic acids, e.g. benzenesulphonic and p-toluenesulphonic acids, and $C_{1-2}$ alkylsulphuric acids. The anions of the acid addition salts, and also of the quaternary ammonium salts are preferably those of a strong inorganic acid, e.g. $Cl^-$, $Br^-$and $SO_4^{2-}$, or of a strong mixed organic-inorganic acid, e.g. $CH_3SO_4^-$, $C_2H_5SO_4^-$ and the benzene- and toluenesulphonic acid anions. Especially preferred are anions of strong inorganic acids, particularly $Cl^-$, and the preferred salts are the acid addition salts, especially with hydrochloric acid.

It is believed that the brightening-eliminating compounds predominantly possess the general formula I,

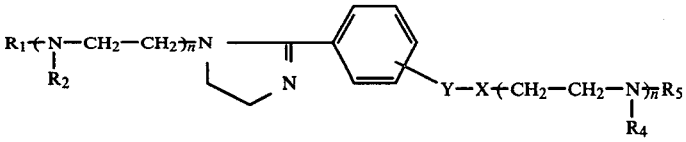

I in which X is the group of formula,

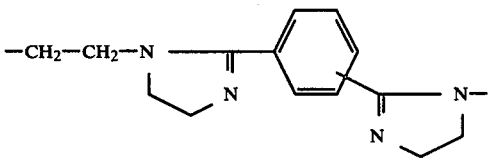

wherein

The benzene radical is attached to the other two parts of the group at its m- or p-positions;

n is an integer 1 to 4, y is, when n is 1, the group —CO—NH—, or, when n is 2 to 4, the group of formula,

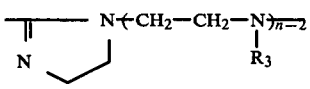

either each of $R_1$, $R_2$, $R_3$, $R_4$ and $R_5$, independently, is hydrogen, methyl, ethyl or methyl or ethyl substituted by phenyl or naphthyl, or $R_2$, $R_3$ and $R_4$ are as defined above, $R_1$ is a bond, and $R_5$ is the group

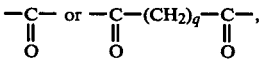

wherein q is an integer 1 to 6, and the group of formula I is the repeating unit of an oligomerous or polymeric compound, the moiety

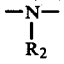

at the end of one terminal unit being terminated by hydrogen, methyl, ethyl or methyl or ethyl substituted by phenyl or naphthyl, and the moiety

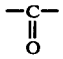

at the end of the other terminal unit being terminated by the group of formula,

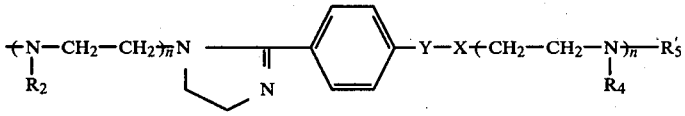

wherein

X, n, Y, $R_2$ and $R_4$ are as defined above, and $R_5'$ is hydrogen, methyl, ethyl or methyl or ethyl substituted by phenyl or naphthyl, and the benzene radicals are attached to the other parts of the compound or group at their m- or p-positions.

Of the brightening-eliminating compounds of formula I, an especially preferred class is constituted by those compounds which contain the repeating unit of formula Ia,

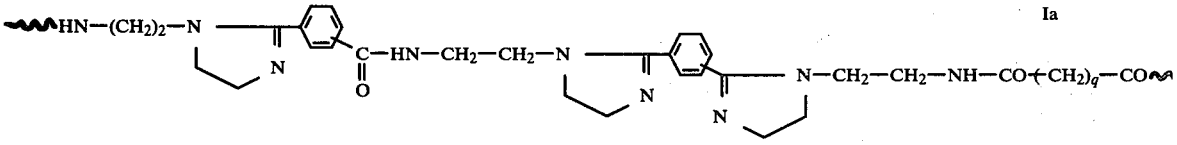

Ia in which q is as defined above.

More preferably, the compounds contain the repeating unit of formula Ia in which q is 4.

Another especially preferred class of the brightening-eliminating compounds is constituted by those compounds which contain the repeating unit of formula Ib,

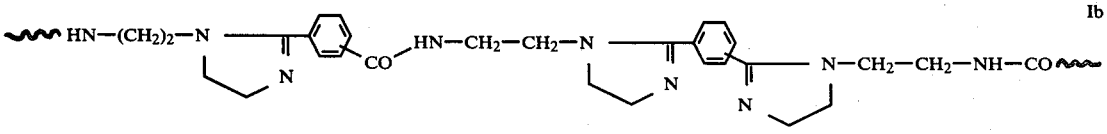

Ib

In each of the above two classes of compounds, the benzene nuclei in the units of formulae Ia and Ib are linked at their m- or p-positions, preferably at their p-positions.

The first stage in producing the brightening-eliminating compounds used as their acid addition or quaternary ammonium salts in the method of the present invention, consists in acylating a polyethylene polyamine of formula II, as given above, with isophthalic or terephthalic acid, or a functional derivative thereof, in a molar ratio of polyamine to acylating agent in excess of 1.5:1. In carrying out such acylation, the cyclization follows. Depending on whether the free acid, an ester or an acid halide is used, there will be elimination of water, water and alcohol, or water and hydrogen halide, respectively, as the reaction proceeds, and it is often advantageous to allow the rapid removal of such by-products from the reaction medium by the use of appropriate distillation apparatus. The acylation/cyclization generally proceeds satisfactorily at a temperature within the range 150° to 250° C., optionally in a reaction-inert organic solvent, e.g. toluene or an xylene. Once the reaction has gone substantially to completion, generally after several hours reaction time, any solvent and excess polyamine may be removed by distillation, preferably under reduced pressure.

The product of the aforedescribed acylation and cyclization procedure is believed to be of the formula IV,

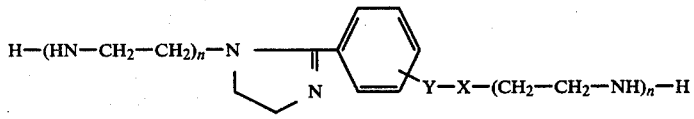

IV in which X, n and Y are as defined above.

Preferably, the starting material of formula II in the above described acylation and cyclization procedure, for reasons of economy and simplicity in use, is that wherein p is 2, i.e. is diethylene triamine.

The next stage consists in either converting the product of the previous acylation and cyclization stage directly into an acid addition salt, or alkylating or acylating it. The purpose of the bifunctional acylating agent, which as hereinbefore indicated is either a saturated aliphatic dicarboxylic acid of formula III or a functional derivative thereof or a functional derivative of carbonic acid, is to link together two or more molecules of the product of the previous stage per molecule of such bifunctional acylating agent, thus affording a polymeric product which may have cross-linking. However, the reaction should be so controlled as to prevent excess polymerization leading to water insolubility of the ultimate salt product used in the method of the present invention. Suitably, the solubility of the salt in water is at least 5% by weight, preferably at least 20%, and especially at least 40%, e.g. 50% by weight. The extent of polymerization tolerable will naturally depend, amongst other factors, on the value of p in the starting material of formula II and the quantity of acylating agent used, but in general suitable conditions for the acylation reaction are afforded by reacting the product of the initial acylation and cyclization stage with the bifunctional acylating agent in a molar ratio of the amount of isophthalic or terephthalic acid used to the amount of bifunctional acylating agent within the range 1:0.3 to 1:1.0, preferably 1:0.4 to 1:0.7, or more preferably 1:0.5, in a reaction inert solvent, preferably propylene glycol, and at an elevated temperature, preferably 150° to 180° C.

A preferred bifunctional acylating agent is adipic acid, or more preferably a bifunctional derivative thereof, in particular a diester, of which adipic acid dimethyl ester is a preferred example. Also preferred as bifunctional acylating agents are phosgene and urea. It is preferred to acylate the product of the initial acylation and cyclization stage, than to convert the latter directly into an acid addition salt.

As an alternative to acylating with a bifunctional acylating agent the product of the initial acylation and cyclization stage, the latter may be alkylated. This may be effected by well-known procedures using such alkylating agents as dimethyl sulphate, diethyl sulphate, benzyl chloride, benzene- or toluenesulphonic acid methyl or ethyl ester, 1-chloromethyl-naphthalene or β-chloroethyl-benzene, which provide the required alkyl groups, viz. methyl or ethyl, optionally substituted by a phenyl or naphthyl group.

If incomplete alkylation has been achieved, i.e. there is present in the alkylation product at least one replaceable hydrogen atom bound to a nitrogen atom, the product may optionally be acylated with a bifunctional acylating agent as hereinbefore indicated. The acylation may be performed as described before for the acylation of the product of the initial acylation and cyclization stage. Alkylation may also follow incomplete acylation.

If it is desired to produce a quaternary ammonium salt of the brightening-eliminating compound, the latter is reacted by well known procedures with the same sort of alkylating agent as hereinbefore described for use only as an alkylating agent. Thus, if such salt of an alkylated compound is desired, the alkylation and quaternary ammonium salt formation may be effected in a single stage using an amount of alkylating agent in excess of that required solely for alkylation. When alkylation and quaternary ammonium salt formation are contemplated, the quaternary ammonium salt used in the method of the invention may not contain a nitrogen atom bearing more than two phenyl- or naphthyl-substituted methyl or ethyl groups. Preferably, any alkyl group introduced by way of alkylation and/or by quaternary ammonium salt formation, is unsubstituted methyl or ethyl.

The hydrosoluble acid addition salt forms of the brightening-eliminating compounds used in the method of the present invention, may be produced either directly from the initial acylation and cyclization product or from the product of the reaction between the latter product and a bifunctional acylating agent and/or an alkylating agent. Such salts may be produced by well known procedures by reacting the free bases with inorganic, organic or aliphatic or aromatic sulphonic acids, as exemplified hereinbefore, in liquid medium which is at least partially aqueous.

According to the method of the present invention, the salt is preferably applied to the material substrate by impregnating the latter with an aqueous solution of the salt. The optical brightener may already be present in the material substrate, or it may be undesirably introduced at the same or a subsequent stage of the processing, such that the brightening-eliminating compound is being used respectively for elimination or prevention of the brightening effects. The method is preferably applied to the treatment of a fibrous material substrate, e.g. a textile substrate constituted by fibres of natural or regenerated cellulose or of polyvinyl alcohol, and more preferably to the treatment of a paper substrate. An optical brightener whose effect is eliminated or prevented by the method is anionic in nature, and more particularly bears sulphonic acid groups. Such optical brighteners of the stilbene series are especially susceptible to subjection to the method. Since these particular optical brighteners are generally used in the treatment of fibrous materials of natural or synthetic origin containing hydroxyl groups, the treatment of these same materials is of considerable importance in the method of the present invention.

In a particular embodiment of the method of the present invention, an aqueous solution of the salt is applied to paper in the stock before sheet formation. The optical brightener may have been in the stock before the salt addition, may be undesirably introduced simultaneously, or may be undesirably introduced at a subsequent stage in the processing of the stock. In another embodiment, paper, e.g. in sheet form, is coated with a paste containing the brightening-eliminating salt. The paste, for example, may be based on starch, and the coating operation, for example, may be a padding process.

The hydrosoluble acid addition or quaternary ammonium salt is preferably applied to the material substrate in an amount by weight from 0.5 to 50 times that of the optical brightener whose effect is to be suppressed.

In the following Examples, which illustrate the production of the brightening-eliminating salts and their use in the process of the present invention, the parts and percentages are by weight.

PRODUCTION EXAMPLE 1

194.2 Parts of terephthalic acid dimethyl ester are introduced at 25° C. with stirring into 1031 parts of diethylene triamine (molar ratio of ester to amine=1:10).

The mixture is heated to 180° C. over the course of 3 hours under an atmosphere of nitrogen. During this period, 52 parts of distillate, having a boiling point of from 80° C. to 162° C., are collected. The distillate consists mainly of methanol.

The mixture is stirred at temperatures ranging from 187° to 199° C. over the course of 7½ hours, during which the water formed in the reaction together with the diethylene triamine is distilled off. The excess diethylene triamine is subsequently removed by vacuum distillation. 255.5 Parts of a product are obtained as residue. This product is dissolved in 115 parts of propylene glycol and 26.3 parts of urea (molar ratio of terephthalic acid to urea=1:0.5) are added thereto. The reaction mixture is stirred at 155°-170° C. over the course of 2 hours. The reaction product is then cooled to 80° C. and neutralized with cooling with 211 parts of 26.6% hydrochloric acid. After cooling, a 50% slightly viscous, brown solution of the hydrochloride salt of the polymeric compound, wherein the group of formula Ib, as hereinbefore given, is the repeating unit, is obtained.

PRODUCTION EXAMPLE 2

194 Parts of terephthalic acid dimethyl ester are introduced with stirring into 877 parts of diethylene triamine (molar ratio of ester to amine=1:8.5). The mixture is heated to 187° C. over the course of 1½ hours, during which time 64 parts of distillate having a boiling point of from 60° C. to 148° C. are collected. The distillate consists mainly of methanol.

During a period of 30 minutes, the temperature is raised to 200° C. and the water formed in the reaction and the excess diethylenetriamine distills off from 160° C. On decreasing the distillation rate, the temperature of the reaction mixture is raised to 225° C. within 3½ hours. After this time, a vacuum of 12 to 13 Torr is applied and distillation is continued for a further hour, 758 parts of a second distillate thereby being collected.

The apparatus is flushed with nitrogen and the residue is dissolved in 140 parts of ethylene glycol at 190°-220° C., after which the solution is cooled to 130° C. and treated with 27 parts of urea (molar ratio of terephthalic acid to urea=1:0.5). The ammonia produced is taken up in dilute hydrochloric acid. After cessation of the gas production, the temperature is raised to 150° C. and the reaction mixture is stirred for a further 3 hours at this temperature.

Thereafter the mixture is cooled to 90°-95° C. and 167 parts of 33% hydrochloric acid are added dropwise at such a rate that the temperature, without external cooling, remains between 90° C. and 100° C. Stirring for a further ¼ hour is effected after the acid addition, the product solution then displaying a pH of 5.5. The polymeric compound produced contains the group of formula Ib, as hereinbefore given, as the repeating unit.

PRODUCTION EXAMPLE 3

The process is effected in accordance with Production Example 1, except that to 255.5 parts of the residue, dissolved in 115 parts of propylene glycol, 74 parts of adipic acid dimethyl ester are added and the reaction mixture is stirred at 155°-175° C. over the course of 2 hours. During this period, the methanol formed in the reaction is distilled off. The reaction product is subsequently cooled to 80° C. and neutralized with cooling with 296 parts of 19.8% hydrochloric acid. A 50%, slightly viscous solution of the hydrochloride salt of the compound, wherein the group of formula Ia, as hereinbefore given and wherein $(CH_2)_q$ is tetramethylene, is the repeating unit, is obtained.

APPLICATION EXAMPLES

1. A 2.5% cellulose suspension, consisting of 50% of bleached beech cellulose and 50% of bleached sulphite cellulose, is brightened with the optical brightener of formula

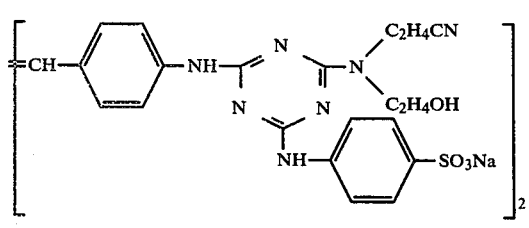

V in an amount 0.1% of the weight of the cellulose. The optical brightener displays its maximum effect within 10 minutes. The suspension is sized with 2% of resin size and 3% of hydrated aluminium sulphate [$Al_2(SO_4)_3.18 H_2O$], based on the weight of the cellulose.

To parts of this suspension are added 1% aqueous solutions containing the hydrochloride salts produced according to Production Examples 1 and 3. In each case, 1% of eliminating agent is added, this figure being based upon the weights of solid eliminating material and cellulose substrate.

5 Minutes after the addition of the eliminating solutions a sheet is formed from the suspensions by means of the Rapid-Köthen apparatus. This sheet is pressed and dried at 90°–100° C. For comparison reasons a sized cellulose sheet and a sized brightened cellulose sheet are produced, in both of which cases no eliminating agent is present.

The elimination of the brightening effect obtained with the optical brighteners is determined according to fluorometry. The hydrochloride salt as produced in Production Example 1 shows the better elimination effect.

2. Dry paper is padded with a bath containing 80 g of starch and 0.6 g of the optical brightener of formula V per liter and expressed to a pick up of 100%. The paper brightened in this way is dried, subsequently padded with a bath containing 1% of the hydrochloride salt as produced in Production Example 1, expressed to a pick up of 100% and dried.

The brightening effect of the optical brightener is thereby almost completely eliminated.

What we claim is:

1. A water-soluble acid addition salt or quaternary ammonium salt of a compound produced by the acylation of an excess of diethylene triamine with isophthalic or terephthalic acid or a functional derivative thereof in a molar ratio of diethylene triamine:acylating agent exceeding 1.5:1, respectively, subsequently cyclizing the product to afford imidazoline groups, said acylation and cyclization being conducted at a temperature of from about 150° C. to about 250° C. for a time sufficient to allow the reaction to substantially reach completion, and reacting the product further by acylation at a temperature of from about 150° C. to about 180° C. in a molar ratio of initial to present acylating agent of 1:0.3 to 1:1.0, respectively, with a bifunctional acylating agent which is a saturated aliphatic dicarboxylic acid of formula, $$HOOC(CH_2)_qCOOH$$

in which q is an integer 1 to 6, or a functional derivative thereof, or a functional derivative of carbonic acid, any free base of the compound resulting from acylation with said bifunctional acylating agent is reacted with sufficient acid to produce an acid addition salt thereof and any quaternary ammonium salt of the compound resulting from acylation with said bifunctional acylating agent is produced by reacting said compound with an alkylating agent to yield a methyl, ethyl or phenyl- or naphthyl-substituted methyl or ethyl group, with the proviso that the quaternary ammonium salt does not contain a nitrogen atom bearing more than two phenyl- or naphthyl-substituted methyl or ethyl groups.

2. A water-soluble acid addition salt or quaternary ammonium salt according to claim 1, in which the salt is one of a compound produced by the acylation of an excess of diethylene triamine with isophthalic or terephthalic acid or a functional derivative thereof in a molar ratio of diethylene triamine:acylating agent exceeding 1.5:1, respectively, subsequently cyclizing the product to afford imidazoline groups, said acylation and cyclization being conducted at a temperature of from about 150° C. to about 250° C. for a time sufficient to allow the reaction to substantially reach completion, and reacting the product further by acylation at a temperature of from about 150° C. to about 180° C. with a saturated aliphatic dicarboxylic acid of formula $$HOOC(CH_2)_qCOOH$$

in which q is an integer 1 to 6, or a functional derivative thereof, in a molar ratio of initial to present acylating agent of 1:0.3 to 1:1.0, respectively, any free base of the compound resulting from acylation with said saturated aliphatic dicarboxylic acid or functional derivative thereof is reacted with sufficient acid to produce an acid addition salt thereof and any quaternary ammonium salt of the compound resulting from acylation with said saturated aliphatic dicarboxylic acid is produced by reacting said compound with an alkylating agent to yield a methyl, ethyl or phenyl- or naphthyl-substituted methyl or ethyl group, with the proviso that the quaternary ammonium salt does not contain a nitrogen atom bearing more than two phenyl- or naphthyl-substituted methyl or ethyl groups.

3. A water-soluble acid addition salt or quaternary ammonium salt according to claim 1, in which the salt is one of a compound produced by the acylation of an excess of diethylene triamine with isophthalic or terephthalic acid or a functional derivative thereof in a molar ratio of diethylene triamine:acylating agent exceeding 1.5:1, respectively, subsequently cyclizing the product to afford imidazoline groups, said acylation and cyclization being conducted at a temperature of from about 150° C. to about 250° C. for a time sufficient to allow the reaction to substantially reach completion, and reacting the product further by acylation at a temperature of from about 150° C. to about 180° C. in a molar ratio of initial to present acylating agent of 1:0.3 to 1:1.0, respectively, with a functional derivative of carbonic acid, any free base of the compound resulting from acylation with said functional derivative of carbonic acid is reacted with sufficient acid to produce an acid addition salt thereof and any quaternary ammonium salt of the compound resulting from acylation with said functional derivative of carbonic acid is produced by reacting said compound with an alkylating agent to yield a methyl, ethyl or phenyl- or naphthyl-substituted methyl or ethyl group, with the proviso that the quaternary ammonium salt does not contain a nitrogen atom bearing more than two phenyl- or naphthyl-substituted methyl or ethyl groups.

4. A water-soluble acid addition salt or quaternary ammonium salt according to claim 2, in which the initial acylating agent used is terephthalic acid or a functional derivative thereof.

5. A water-soluble acid addition salt or quaternary ammonium salt according to claim 2, in which q in said saturated aliphatic dicarboxylic acid is 4.

6. A water-soluble acid addition salt or quaternary ammonium salt according to claim 2, in which the initial acylating agent used is dimethyl terephthalate and the product of the initial acylating and cyclization steps is acylated with dimethyl adipate.

7. A water-soluble acid addition salt or quaternary ammonium salt according to claim 3, in which the initial acylating agent used is terephthalic acid or a functional derivative thereof.

8. A water-soluble acid addition salt or quaternary ammonium salt according to claim 3, in which the initial acylating agent used is dimethyl terephthalate and the product of the initial acylation and cyclization steps is acylated with urea.

9. A water-soluble acid addition salt or quaternary ammonium salt according to claim 1, in which the acid from which the acid addition salt is derived is selected from the group consisting of inorganic acids, aromatic sulphonic acids and $C_{1-2}$-alkylsulphuric acids.

10. A water-soluble acid addition salt or quaternary ammonium salt according to claim 9, in which said inorganic acids are hydrochloric, hydrobromic and sulphuric acids, and said aromatic sulphonic acids are benzenesulphonic and p-toluene-sulphonic acids.

11. A water-soluble acid addition salt or quaternary ammonium salt according to claim 1, in which the anion of the acid addition or quaternary ammonium salt is that of a strong inorganic acid or of a strong mixed organic-inorganic acid.

12. A water-soluble acid addition salt or quaternary ammonium salt according to claim 11, in which said anion is $Cl^-$.

13. A water-soluble acid addition salt or quaternary ammonium salt according to claim 12, in which the salt is an acid addition salt with hydrochloric acid.

* * * * *

UNITED STATES PATENT AND TRADEMARK OFFICE

CERTIFICATE OF CORRECTION

PATENT NO. : 4,210,763

DATED : July 1, 1980

INVENTOR(S) : Giuseppe Raspanti

It is certified that error appears in the above—identified patent and that said Letters Patent is hereby corrected as shown below:

Col. 1, line 10; after "continuation", delete the comma.

Col. 2, line 14; before "benzene", delete "The" and insert in its place --the--.

Col. 3, line 23; before "benzene", delete "The" and insert in its place --the--.

Col. 3, line 26; delete "y" and insert in its place --Y--.

Signed and Sealed this

*Fourth* Day of *May 1982*

[SEAL]

*Attest:*

GERALD J. MOSSINGHOFF

*Attesting Officer*

*Commissioner of Patents and Trademarks*